United States Patent [19]

Archer et al.

[11] 3,984,058

[45] Oct. 5, 1976

[54] MEANS FOR HOLDING DIES IN A JAW CRUSHER

[75] Inventors: Fred Curtis Archer, Whitefish Bay; Joseph Batch, Milwaukee, both of Wis.

[73] Assignee: Barber-Greene Company, Aurora, Ill.

[22] Filed: Nov. 26, 1975

[21] Appl. No.: 635,687

[52] U.S. Cl. ..... 241/264; 241/285 R

[51] Int. Cl.[2] ..... B02C 1/10

[58] Field of Search ..... 241/198 R, 198 A, 262, 241/264–269, 285 R, 291

[56] References Cited

UNITED STATES PATENTS

| | | | |
|---|---|---|---|
| 2,235,097 | 3/1941 | Benson | 241/285 R |
| 2,302,723 | 11/1942 | Symons | 241/266 X |
| 3,140,057 | 7/1964 | Pollitz | 241/285 |
| 3,473,744 | 10/1969 | De Diemar et al. | 241/267 |
| 3,804,345 | 4/1974 | De Diemar | 241/264 |

FOREIGN PATENTS OR APPLICATIONS

| | | | |
|---|---|---|---|
| 774,862 | 5/1957 | United Kingdom | 241/267 |

*Primary Examiner*—Granville Y. Custer, Jr.
*Assistant Examiner*—Howard N. Goldberg
*Attorney, Agent, or Firm*—James E. Nilles

[57] ABSTRACT

A securing means for supporting a stationary die plate in a jaw crusher including the combination of angular cored pockets located in the vertical side walls of the stationary die plate and a plurality of lever-like angular wedges which are receivable in the pockets in such a manner that the stationary die plate can be forced against a supporting wall. The lever-like wedges are pivotably mounted against side walls of the jaw crusher and are bolted to the side walls in such a manner that tightening of the bolts causes the ends of the wedges which are received in the angular pockets of the die plates to apply compressive forces against the die plate forcing the die plate against the supporting wall.

8 Claims, 5 Drawing Figures

MEANS FOR HOLDING DIES IN A JAW CRUSHER

BACKGROUND OF THE INVENTION

The present invention pertains to jaw crushers for stones and the like and which include stationary and swingable die plates which function as crushing surfaces. More particularly, the invention relates to means for mounting the stationary jaw die plate in such a manner that it is rigidly secured but readily removable.

Prior art jaw crushers have provided various means for retaining the stationary jaw die plate, but each of these various means have had disadvantages. For example, some of the prior art jaw crushers have provided elongated wedges or retaining plates which clampingly engage the edges of the jaw plate in order to secure it to the frame member. These means of securing the jaw plate have the disadvantage that they do not allow the plate to expand sufficiently when it undergoes expansion as a result of the peening effect of the rock being crushed. Other types of prior art crushers include bolts which extend through pockets in the die plate and which are secured to frame members as a means for supporting the die plates. Generally this method has the drawback that it is undesirable to provide pockets or bores which extend through the die plate because these bores can effect the performance of the crusher and the durability of the die plates. Furthermore, the bolts used to secure the plates are usually relatively inaccessible and removal of the plates or tightening of the bolts is generally a difficult and time consuming task. Other prior art alternative securing means have included the use of two-piece cheekplates which are used to support the opposite side edges of the stationary jaw die plate. In such securing means, one of the cheekplate pieces is secured to the frame side plates of the jaw crusher and adjacent to one of the side edges of the jaw die, and the other cheekplate piece which has a generally wedged shape is forced between the secured cheekplate piece and the edge of the jaw die plate thereby forcing the jaw die against a supporting surface. Such wedge securing means have the disadvantage that during the rock crushing operation the peening action of the rock against the cheekplates tends to lock the wedge portion so firmly in place that it cannot be removed without use of a cutting torch. Since the cheekplates are comprised of manganese steel and are rather sizable, this type of removal process destroys expensive parts and is time consuming.

SUMMARY OF THE INVENTION

The present invention provides an improved means for securing the stationary die plate used in a jaw crusher apparatus. The securing means include pockets provided in the vertical sides of the stationary jaw die plate for receiving angular lever-like wedges which can be bolted to the housing side plates. The pockets in the sides of the stationary jaw die include angular walls, one of which slidingly receives one end of the lever-like wedge. When the wedges are bolted to the housing side plate and the bolts are tightened, the lever-like wedges are forced to pivot with respect to the housing side plate and to force the stationary jaw die securly against an upright wall of the housing. Rock being crushed between the jaws, acts to place additional forces on the lever-like wedges and drives them further toward the housing side plate and causes the stationary jaw die in turn to be forced against the end wall of the housing.

The shape of the pockets is such that in the event that peening of the stationary jaw die causes lateral expansion of the jaw die, the angular wall abutting the end of the wedge can slide with respect to that end facilitating such lateral expansion. Furthermore, the stationary jaw die is not rigidly secured along its upper or lower edges and is thus permitted vertical expansion.

A further advantage of the invention is that the angular wedges can be easily removed by removing the securing bolts or, if necessary, cutting them with a cutting torch in order to permit replacement or removal of the stationary jaw die. It is not necessary to produce the angular wedges from manganese steel and they can be relatively small such that if it is necessary to use a cutting torch to cut the angular wedges to permit their removal, the cutting process is not costly nor wasteful of expensive parts.

DESCRIPTION OF THE PREFERRED EMBODIMENT

Figure 1:
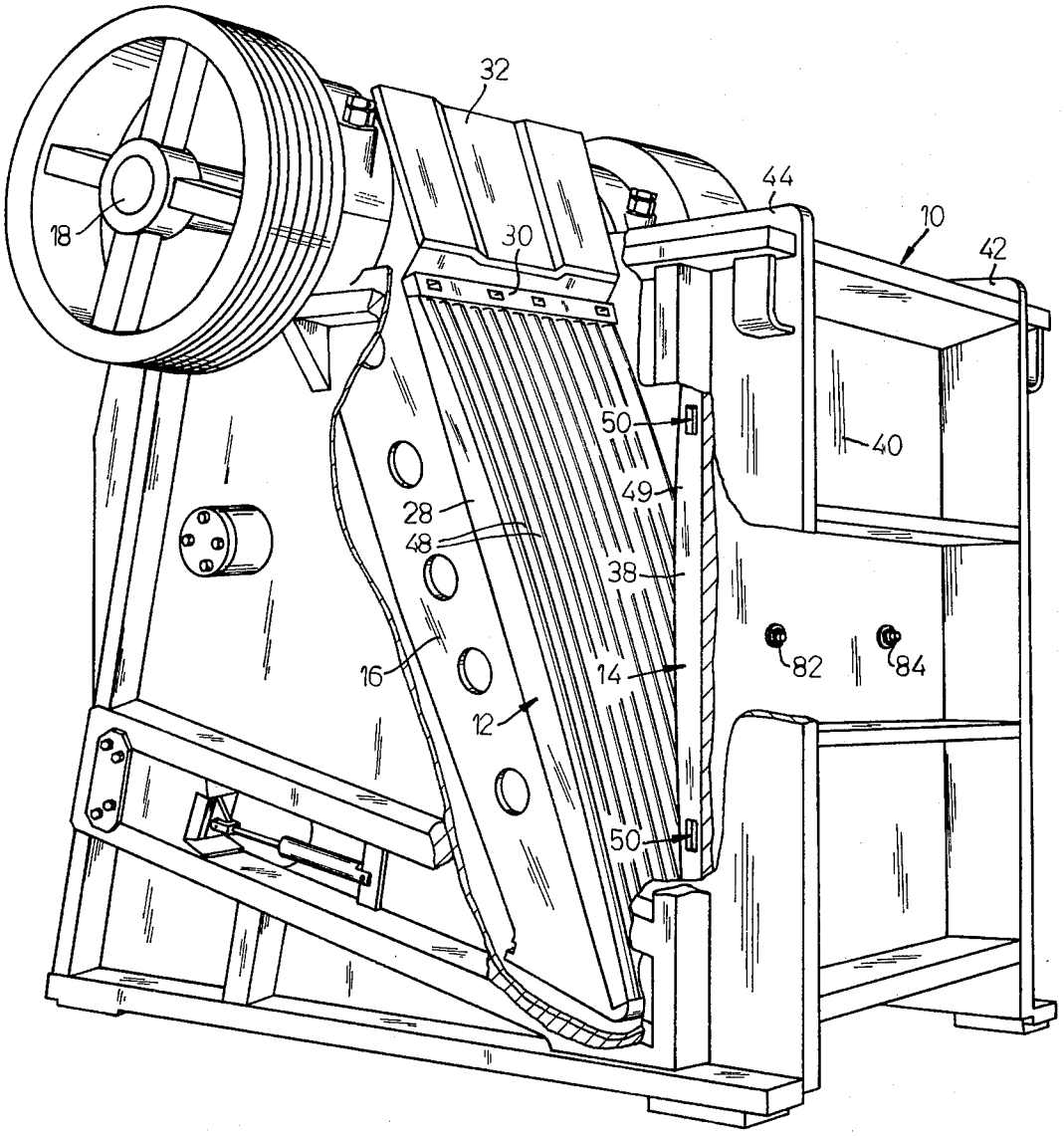
FIG. 1 is a perspective view of a rock crusher with parts broken away to illustrate the die plates.
Figure 3:
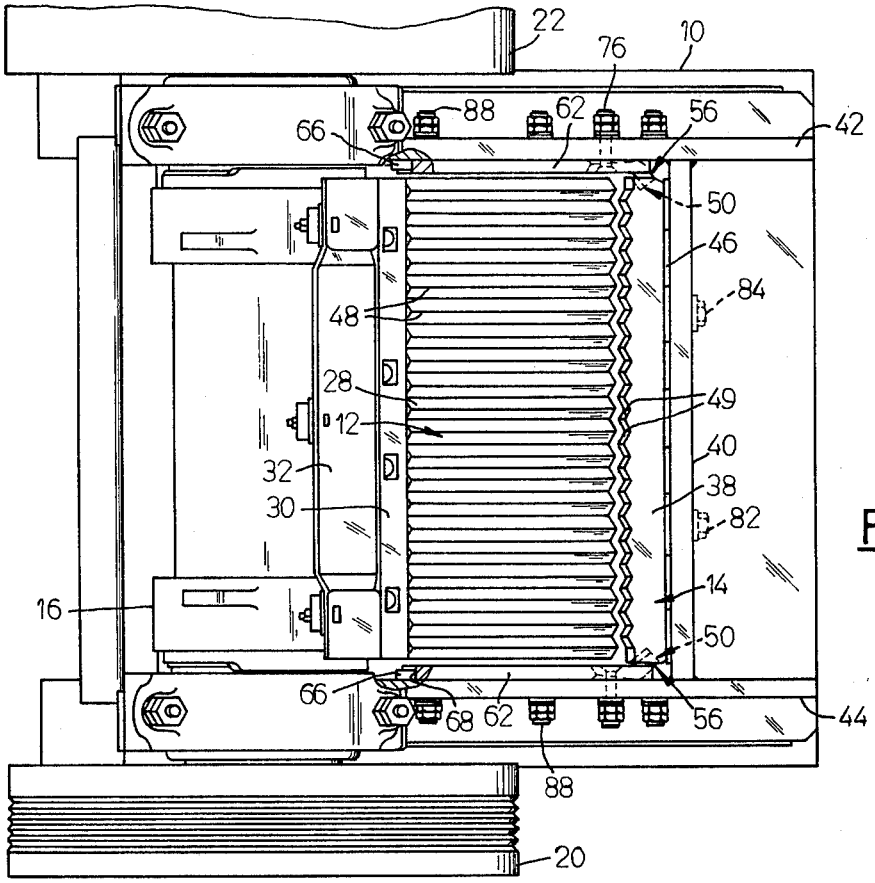
FIG. 3 is a plan view of the rock crusher shown in FIG. 1.
Figure 2:
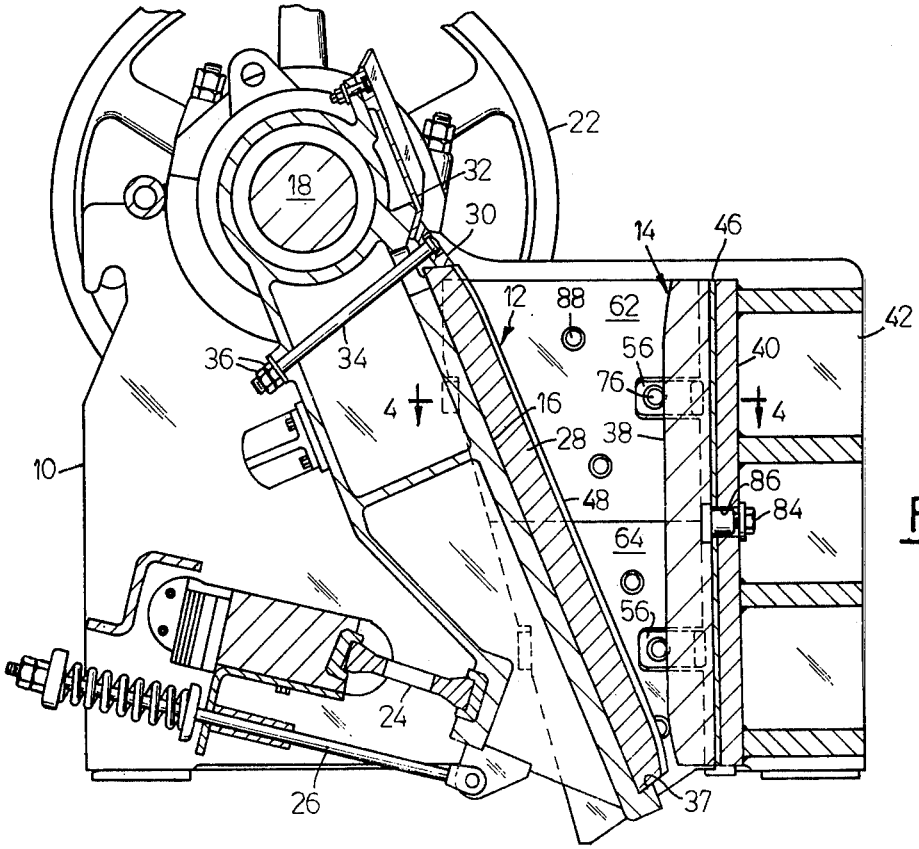
FIG. 2 is a cross-sectional side view of the rock crusher shown in FIG. 1.

The jaw crusher shown in FIGS. 1–3 is comprised of a housing 10 which generally functions to support a swingable jaw 12 and a stationary jaw 14. The swingable jaw 12 incorporates a cast steel pitman 16 which is conventionally mounted with respect to the housing 10 by means of an eccentric shaft 18. A driving sheave 20 and a fly wheel 22 are mounted on opposite ends of the shaft 18, and a toggle plate 24 and a spring loaded retainer rod 26 are operatively interposed between the free swinging end of the pitman 16 and the lower portion of the housing 10 in a conventional manner.

The pitman 16 is provided with a cast manganese steel die plate 28 secured in place by retaining wedges 30 which engage a bevelled upper edge of the die plate 28 and the adjacent bevelled edge of the conventional hub guard 32. The wedge 30 is held in place by a plurality of bolts 34 which are received in bores in the pitman 16 and secured by associated nuts 36. The lower edge of the die plate 28 is bevelled to be received in engagement with a corresponding bevelled retaining ledge 37 at the lower end of the pitman 16.

The swingable jaw 12 is operable as a rock crushing means in a conventional manner with the stationary jaw 14 which includes a cast manganese steel die plate 38 secured against vertical supporting wall 40. The supporting wall 40 is in turn supported at its laterally opposite ends by side plates 42 and 44 which are integral with the housing 10. Machine seating strips 46 are disposed between the back side of the stationary jaw die 38 and the supporting wall 40.

Both of the jaw die plates 28 and 38 are corrugated in a conventional manner in order to provide the required crushing action when material is fed therebetween and include transversely spaced ribs 48 and 49 respectively which extend lengthwise between the opposite ends of the die plates.

FIGS. 2–5 best illustrate the manner of the present invention for securing the stationary jaw die plate 38 to the supporting wall 40. The vertical sides of the jaw die plate 38 are each provided with two cored wedge shaped pockets 50 which include angularly disposed side walls 52 and 54. The pockets 50 are each designed to receive one end of a lever-like wedge 56 which is secured to one of the housing side plates 42 or 44. The wedges 56 each include a lever arm portion 57 and a pressure applying arm 59 disposed in angular relationship with respect to each other and joined at an angular surface or corner 61. The corner 61 is received in abutting relationship against the surface of the plate 42 or 44 such that the wedge is pivotable about the corner 61. The pressure applying arms 59 of the wedges 56 have a flat end surface receivable against the side wall 54 of the pocket 50. The lever am 57 of the wedge 56 is somewhat tapered and includes a countersunk bore 63 therethrough for receiving a bolt 76, whereby torque can be placed on the wedge by tightening the bolt 76, causing pivoting or rocking movement of the wedge around the angular surface 61 and thereby forcing the end of the pressure applying arm 59 into engagement with the surface 54. It should be noted that such pivotal movement of the wedges 56 around the angular surface or corner 61 in response to tightening of the bolts 76 causes the ends of the pressure applying arms 59 to place a generally normal force on the walls 54, one component of the force acting to secure the die plate 38 against the supporting wall 40 and the other component placing a compressive force on the die plate to prohibit lateral movement. The combination of forces applied by the wedges 56 is sufficient to rigidly secure the stationary jaw die plate 38 against the machine seating strips 46 and against the upright supporting wall 40.

The angular wedges 56 are supported in an aligned position with respect to the pockets 50 in recesses 58 and 60 which are provided in the upper and lower cheekplates 62 and 64. Both of the recesses 58 and 60 are provided with bevelled surfaces 72 for receiving a complementary bevelled surface 74 at the end of the lever arm 57. When the bolts 76 draw the lever arms 57 into the recesses 58 and 60, the complementary bevelled surfaces 72 and 74 function to cause the wedge 56 to be forced into the pockets 50 against the surface thereby providing additional means for forcing the die plate 38 against the supporting wall 40.

The cheekplates 62 and 64 are secured by bolts 88 to the housing side plates 42 and 44 in a properly aligned position with respect to the stationary jaw die plate 38 such that the recesses 58 and 60 in the upper and lower cheekplates 62 and 64 will provide support for the angular wedges 56 received therein. The cheekplates 62 and 64 are secured in this position by stop blocks 66 which are welded to the housing side plates 42 and 44 and which are received within recesses 68 and 70 disposed in the respective cheekplates.

The bolts 76 used to secure the wedges 56 to the housing side plates, and the bolts 88 used to secure the cheekplates to the housing side plates, can be securely engaged by a resilient washer 90, a steel washer 92, a hex nut 94 and a jam nut 96.

The stationary jaw die 38 is further secured against movement by a pair of retaining keys 82 and 84 which are secured to the supporting wall 40 so as to project therefrom and which are received in closely fitting engagement in cored pockets 86 in the rear wall of the die 38. The retaining keys 82 and 84 are centrally positioned with respect to the die plate 38 such that they do not restrict expansion of the die plate when the die plate expands in response to the peening action of the rock being crushed. Though the drawings illustrate the use of a pair of horizontally aligned retaining keys, additional keys could also be provided, positioned for example, along a vertical center line.

Figure 4:
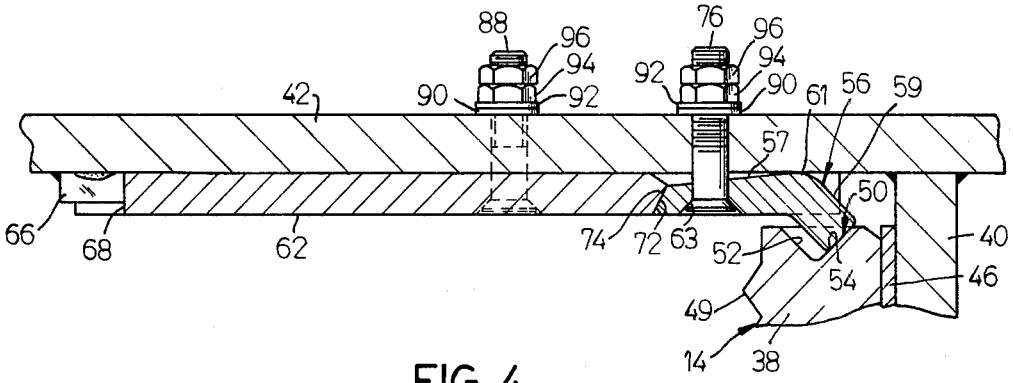
FIG. 4 is a cross-sectional view taken generally along the line 4—4 in FIG. 2 and showing the means of the present invention for securing the stationary jaw die, the movable jaw being omitted.
Figure 5:
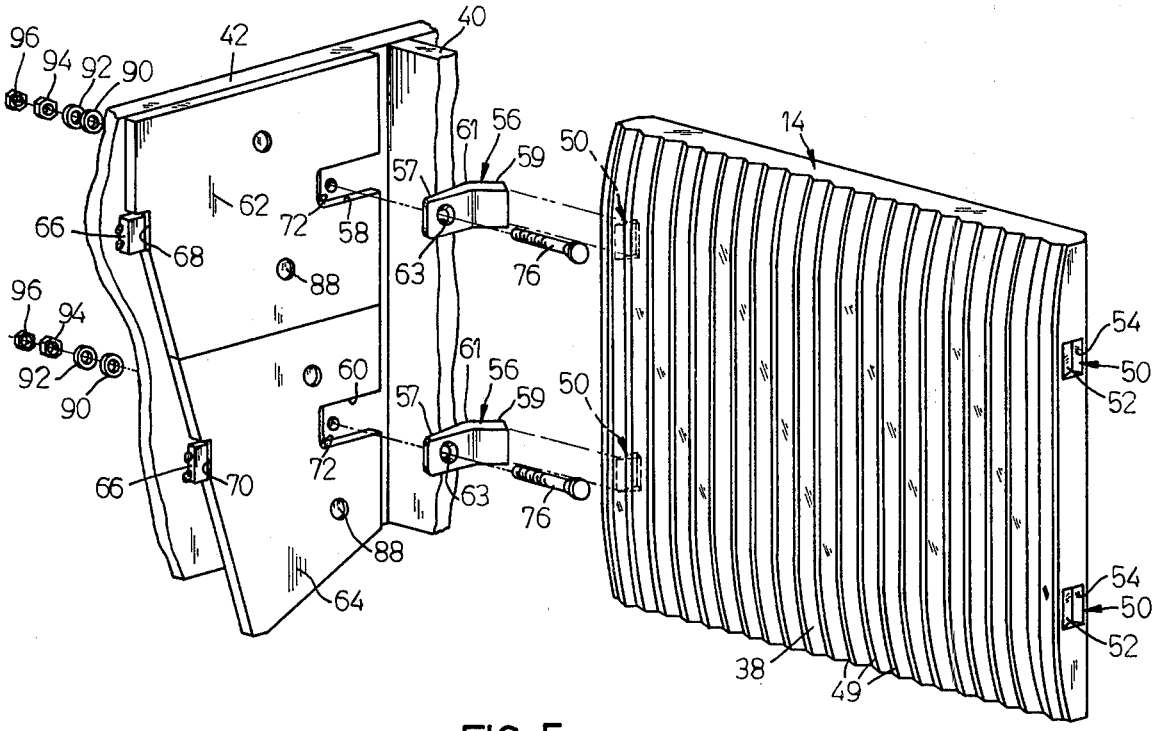
FIG. 5 is an exploded isometric view showing the means of the present invention for securing the stationary jaw die.

The assembly of the wedges 56 and the pockets 50 also function to accommodate expansion in response to the peening action of the crushing process. As shown in FIG. 4, the flat end of the pressure applying arm 59 of the wedge 56 is received against the surface of the side wall 54 in such a manner that sliding movement between the end of and the side wall 54 is possible. Expansion of the die plate in a lateral direction will result in such a sliding movement of the wall 54 with respect to the end 59 of the wedge. It should be further noted, that such sliding movement will cause the die plate 38 to be forced into an even tighter engagement with the supporting wall 40.

The assembly of the present invention for securing the stationary jaw die in place, is particularly advantageous in that rock being crushed between the swingable and stationary jaw 12 and 14 often hammers against the exposed surfaces of the wedges 56 and drives them toward the housing side plate and in turn causes them to force the stationary jaw die 38 even more tightly against the upright wall 40.

The embodiment of the invention illustrated in the drawings and described above, employs the use of two angular lever-like wedges 56 on each side of the stationary jaw die but it should be readily apparent that three or more of these units could be used, the number of wedges required depending upon the size of the jaw die and the force on it. The stationary jaw die plate 38, is comprised of a single piece, however, the securing means of the present invention is equally useful when the die plate is comprised of two or more vertically stacked plates.

Resume

The apparatus of the present invention is an improvement over the prior art in that it provides a means for rigidly securing the stationary jaw die plate against the upright supporting wall without requiring the die plate to include cored bores through it. The angular wedges which secure the jaw die plate and the shape of the bores are also particularly advantageous in that they readily permit expansion of the die plate which is caused by either thermal expansion or the peening action of the rock being crushed. Furthermore, the die plate securing means of the invention facilitates relatively convenient removal of the die plates such that they can be replaced. In the event that the peening action of the rock has caused the wedges to become locked in place, it is not difficult to remove the wedges with a cutting torch since they are of relatively small size and are not necessarily constructed from manganese steel or other similar very hard types of steel and are thus relatively inexpensive to replace.

The securing means of the present invention thus provides means for solidly locking the stationary die plate in position without requiring bores extending through the die plate and without requiring large wedges or clamping plates secured to the edges of the die plate. The securing means of the invention also permits the die plate to be relative easily removed and avoids expensive and time consuming removal processes. We claim:

1. In a jaw crusher, a securing means for releasably supporting a stationary jaw die plate wherein said jaw crusher includes a pair of side plates and a rigid wall located between said side plates, said stationary jaw die plate abutting against said rigid wall, said securing means comprising: pocket means disposed in opposite sides of said stationary jaw die plate, at least a pair of wedge means, each of said wedge means being receivable in said pocket means and secured to one of said side plates, and including means for pivoting said wedge means into forcible abutment with said stationary jaw die plate to force the latter against said rigid wall.

2. A jaw crusher set forth in claim 1 further characterized in that each of said wedge means includes an angular shaped wedge having a lever arm and having a pressure applying arm disposed in an angular relationship with said lever arm, said wedge means also having a corner disposed between said arms and for abutment against and in rocking relationship with said side plate, and wherein said pivoting means includes adjustable means for securing said lever arm to said side plate and for causing said wedge means to pivot about said corner thereby forcing said pressure applying arm tightly against said die plate to force the latter against said rigid wall.

3. The jaw crusher set forth in claim 2 further characterized in that said side plate includes a cheekplate secured thereto, said cheekplate having a recess for the reception of said lever arm of said wedge means to thereby accurately locate said wedge means and maintain alignment of said wedge means in said die plate pocket means when said lever arm is forced toward said side plate.

4. The jaw crusher set forth in claim 1 further including cheekplate means secured to said side plates and including recess means therein for receiving a portion of said wedge means therein and for aligning said wedge means, and wherein said pocket means are disposed in opposed relationship in vertically extending walls of said die plate and include angular walls therein, said wedge means engaging at least one of said angular walls to force said jaw die plate against said rigid wall but permitting expansion of said die plate.

5. The jaw crusher set forth in claim 1 wherein said wedge means each include a pair of ends angularly disposed with respect to each other and including a corner portion intermediate said ends and receivable in rocking engagement with one of said side plates, one of said angularly disposed ends receivable in said pocket means and the other of said ends movably secured to one of said side plates by said means for pivoting said wedge means.

6. In a jaw crusher, a securing means for releaseably supporting stationary jaw die plates wherein said jaw crusher includes a pair of side plates and a rigid wall located between said side plates, said stationary jaw die plate abutting against said rigid wall, said securing means comprising: restraining key means secured to said rigid wall and projecting therefrom, bore means in said die plate for receiving said restraining key whereby said die plate is restricted against movement parallel to said rigid wall, pocket means disposed in opposite sides of said die plate, at least a pair of wedge means, each of said wedge means being receivable in said pocket means and secured to one of said side plates, and means for pivoting said wedge means into forcible abutment with said die plate whereby said die plate is restrained against movement in a direction normal to said rigid wall and laterally parallel to said rigid wall.

7. A jaw crusher set forth in claim 6 further characterized in that each of said wedge means includes an angular shaped wedge having a lever arm and having a pressure applying arm disposed in an angular relationship with said lever arm, said wedge means also having a corner disposed between said arms and for abutment against and in rocking relationship with said side plate, and wherein said pivoting means includes adjustable means for securing said lever arm to said side plate and for causing said wedge means to pivot about said corner thereby forcing said pressure applying arm tightly against said die plate to force the latter against said rigid wall.

8. The jaw crusher set forth in claim 7 further characterized in that said side plate includes a cheekplate secured thereto, said cheekplate having a recess for the reception of said lever arm of said wedge means to thereby accurately locate said wedge means and maintain alignment of said wedge means in said die plate pocket means when said lever arm is forced toward said side plate.

* * * * *